US008190046B2

(12) United States Patent
Kataoka et al.

(10) Patent No.: US 8,190,046 B2
(45) Date of Patent: May 29, 2012

(54) IMAGE FORMING APPARATUS EMPLOYING FIXING DEVICE AND CONTROL METHOD THEREFOR

(75) Inventors: Kaoru Kataoka, Ebina (JP); Shunichi Oohara, Yokohama (JP); Hiroyuki Seki, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 419 days.

(21) Appl. No.: 12/560,987

(22) Filed: Sep. 16, 2009

(65) Prior Publication Data

US 2010/0074642 A1 Mar. 25, 2010

(30) Foreign Application Priority Data

Sep. 19, 2008 (JP) ..... 2008-240229

(51) Int. Cl.
*G03G 15/20* (2006.01)

(52) U.S. Cl. ..... 399/67; 399/45; 399/44

(58) Field of Classification Search ..... 399/38, 399/45, 67, 323, 399, 21, 44
See application file for complete search history.

(56) References Cited

U.S. PATENT DOCUMENTS 6,668,155 B1 * 12/2003 Hubble et al. ..... 399/406

FOREIGN PATENT DOCUMENTS

| | | |
|---|---|---|
| JP | 9-90668 | 4/1997 |
| JP | 2000-247526 | 9/2000 |
| JP | 2000-356861 | 12/2000 |
| JP | 2006-264921 | 10/2006 |

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

An image forming apparatus includes a controller, a database, an image carrier, a transfer unit, a fixing device including a temperature detector and a first drive device, a speed changer, and an electric-current detector. The controller calculates a toner adhesion amount of a recording medium, identifies a type of the recording medium, detects a temperature of the fixing device, determines a moisture content of the recording medium, calculates a reaction force of the recording medium, calculates a toner adhesion force, compares the reaction force and the toner adhesion force, determines a fixing nip angle, drives the first drive device to set the fixing device to the fixing nip angle, determines a target feed speed of the recording medium, and drives the speed changer to change a feed speed of the recording medium to match the target speed.

6 Claims, 6 Drawing Sheets

FIXING UNIT SEEN FROM VIEW POINT Z

IMAGE FORMING APPARATUS EMPLOYING FIXING DEVICE AND CONTROL METHOD THEREFOR

CROSS-REFERENCE TO RELATED APPLICATIONS

The present patent application claims priority pursuant to 35 U.S.C. §119 from Japanese Patent Application No. 2008-240229, filed on Sep. 19, 2008 in the Japan Patent Office, which is incorporated herein by reference in its entirety.

BACKGROUND OF THE INVENTION

1. Field of the Invention

Illustrative embodiments of the present invention relate to an image forming apparatus, such as a copier, a facsimile, or a laser printer, which forms an image by electrostatic charge, and a control method therefor.

2. Description of the Background

Image forming apparatuses are used as printers, facsimile machines, copiers, plotters, or multi-functional peripherals having several of the foregoing capabilities. Electrophotographic image forming apparatuses that form an image with toner generally fix the toner on a recording medium, such as a sheet of paper, using heat and pressure. For example, in one technique, a heating roller or belt is used to heat the recording medium.

In such a technique, not only toner but also the recording medium having the toner is entirely heated, causing deformation of the recording medium. Hence, certain mechanisms to correct such deformation have been proposed. For example, one known technique proposes that a curl correction device to correct curling of the recording medium is provided with two sheet paths.

In another known technique, detecting curling of the recording medium after toner fixation is proposed to detect deformation of the recording medium.

Still another known technique proposes changing the composition of the recording medium to prevent heat deformation of the recording medium.

However, in the above-described known techniques in which a recording material, such as toner or other resin, is fixed on the recording medium using heat and pressure, not only the recording material to be fixed but also the recording medium itself is heated. Consequently, the recording medium is deformed (curled), resulting in a reduced commercial value of printed matter or a reduced reliability of the apparatus sheet feed mechanism.

How much a recording sheet curls is known to vary with the moisture content of the recording sheet. Further, such curl varies with the heating temperature, sheet type, and thickness of the recording sheet. When a relatively large adhesive force is applied by a heat fixing portion of the fixing device to the recording sheet, the recording medium does not fully separate from the heat fixing portion, causing a failure such as wrapping of the recording medium around the fixing device. Further, such a failure may reduce productivity, accelerate wear on consumable components, and damage mechanical components.

Still yet another known technique proposes changing a processing speed of the apparatus in accordance with the moisture content of the recording medium. However, such technique does not take into consideration the amount of toner adhering to the recording medium. Toner fuses under high temperatures, creating adhesive force, and the greater the amount of toner adhering to the recording medium, the greater the adhesive force. Accordingly, a technique in which only the moisture content of the recording medium is taken into account is insufficient to prevent curling of the recording medium. Separation of the recording medium from the fixing device depends on the type of image formed on the recording medium, and occurrence of a failure such as wrapping of the recording medium around the fixing device may depend on the adhesive force varying with the toner adhesion amount. Such effect of the toner adhesion amount may be particularly noticeable when the temperature of the fixing device is relatively high.

SUMMARY OF THE INVENTION

The present disclosure provides an image forming apparatus capable of correcting deformation of a recording medium and a control method therefor.

In one illustrative embodiment, an image forming apparatus includes a controller, a database to register information on a plurality of types of recording media in the controller, an image carrier to carry a toner image, an exposure unit to expose the image carrier, a transfer unit to transfer the toner image from the image carrier to a recording medium, a fixing device to fix the toner image transferred on the recording medium at the transfer unit using heat and pressure and includes a temperature detector to detect a temperature of the fixing device and a first drive device to change a fixing nip angle of the fixing device, which is an angle of departure of the recording medium from the fixing device, a speed changer disposed at an upstream side of the fixing device in a feed direction of the recording medium to change a feed speed of the recording medium, and an electric-current detector disposed at an upstream side of the transfer unit in the feed direction of the recording medium to measure an electric current flowing through the recording medium. The controller calculates a toner adhesion amount of toner adhering to the toner image on the recording medium from an exposure amount of the exposure device, identifies a type of the recording medium based on the information on the plurality of types of recording media registered in the database when the recording medium is selected from the plurality of recording media by a user, detects a temperature of the fixing device with the temperature detector, determines a moisture content of the recording medium from the electric current flowing through the recording medium measured with the electric-current detector, calculates a reaction force of the recording medium arising when the recording medium is fed out of the fixing device, calculates from the toner adhesion amount a toner adhesion force generated by the toner image fused with the heat of the fixing device, compares the reaction force and the toner adhesion force, determines the fixing nip angle when the controller determines that the reaction force exceeds the toner adhesion force, drives the first drive device to set the fixing device to the fixing nip angle, determines a target speed of the feed speed of the recording medium, and drives the speed changer to change the feed speed of the recording medium to match the target speed.

In another illustrative embodiment, an image forming apparatus control method for controlling operation of an image forming apparatus is disclosed. The image forming apparatus includes a controller, a database to register information on a plurality of types of recording media in the controller, an image carrier to carry a toner image, an exposure unit to expose the image carrier, a transfer unit to transfer the toner image from the image carrier to a recording medium, a fixing device to fix the toner image transferred on the recording medium at the transfer unit using heat and pressure and includes a temperature detector to detect a temperature of the fixing device and a first drive device to change a fixing nip angle of the fixing device, which is an angle of departure of the recording medium from the fixing device, a speed changer disposed at an upstream side of the fixing device in a feed direction of the recording medium to change a feed speed of the recording medium, and an electric-current detector disposed at an upstream side of the transfer unit in the feed direction of the recording medium to measure an electric current flowing through the recording medium. The method includes calculating a toner adhesion amount of toner adhering to the toner image on the recording medium from an exposure amount of the exposure device, identifying a type of the recording medium based on the information on the plurality of types of recording media registered in the database when the recording medium is selected from the plurality of recording media by a user, detecting a temperature of the fixing device with the temperature detector, determining a moisture content of the recording medium from the electric current flowing through the recording medium measured with the electric-current detector, calculating a reaction force of the recording medium arising when the recording medium is fed out of the fixing device, calculating from the toner adhesion amount a toner adhesion force generated by the toner image fused with the heat of the fixing device, comparing the reaction force and the toner adhesion force, determining the fixing nip angle when the controller determines that the reaction force exceeds the toner adhesion force, driving the first drive device to set the fixing device to the fixing nip angle, determining a target speed of the feed speed of the recording medium, and driving the speed changer to change the feed speed of the recording medium to match the target speed.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
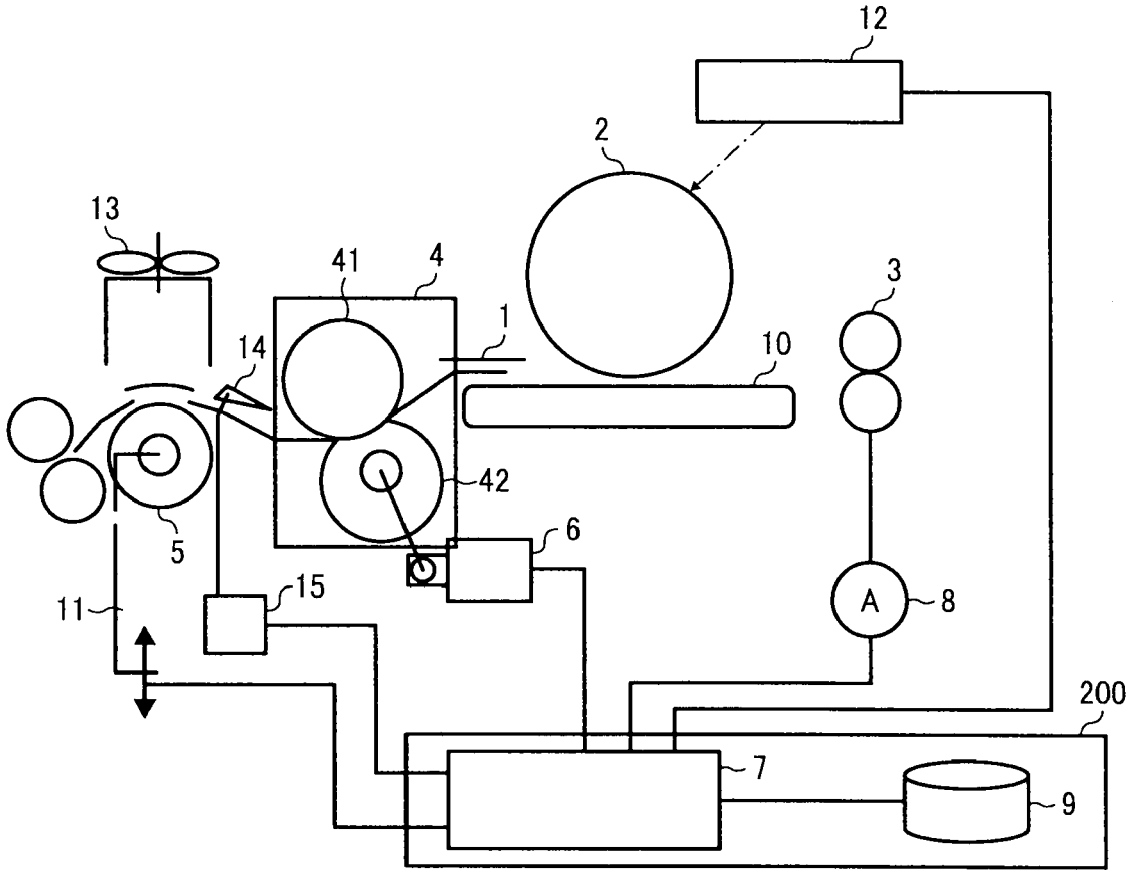
FIG. 1 is a schematic view illustrating a configuration of an image forming apparatus according to illustrative embodiments of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

FIG. 1 is a schematic view illustrating a configuration of an image forming apparatus according to an illustrative embodiment of the present disclosure. In FIG. 1, a toner image developed by a development device, not illustrated, is carried on a photoconductor drum 2 serving as an image carrier and transferred onto a recording sheet 1 by a transfer unit. The sheet having the toner image is fed to a fixing device 4 by a sheet conveyance belt 10 that is driven by a drive motor. The speed of the sheet conveyance belt 10 is variable. The fixing device 4 fixes the toner image on the recording sheet 1 using heat and pressure. The fixing device 4 includes a heat roller (hereinafter, referred to as "HR") 41 with a heat source and a buck-up roller (hereinafter, referred to as "BR") 42. Each of the HR 41 and the BR 42 consists of a core metal (base material) made of aluminum coated with a silicone rubber layer. The HR 41 and the BR 42 are different in rubber hardness, and the HR 41 has a rubber hardness higher than a rubber hardness of the BR 42. A fixing nip between the HR 41 and the BR 42 is formed in a slightly downward convex shape. Accordingly, the sheet 1 is fed from the fixing nip toward the HR 41 disposed at the upper side of the BR 42. In such a configuration, the sheet 1 is deformed in a downward convex shape. Hence, before the temperature of the sheet 1 fed from the fixing device 4 drops, such deformation is corrected using a roller of a decurler 5 disposed at a downstream side of the fixing device 4 in a feed direction of the sheet 1. The roller of the decurler 5 is moved up and down through control of a decurler drive motor 11. The decurler 5 includes a cooling device 13 that cools the temperature of the sheet 1 heated at the fixing device 4.

At an upstream side of the transfer unit in the sheet feed direction is disposed a moisture-content detection roller 3 that measures an electric current flowing through the sheet 1 using a sheet-moisture-content measurement ammeter 8 to determine the moisture content of the sheet 1. The fixing nip is formed by the contact of the HR 41 and the BR 42, and the angle of departure of the sheet 1 from the fixing nip (hereinafter "fixing nip angle") is adjusted by driving an actuator 6 serving as a first drive device, which is described later. The fixing device 4 includes a separation claw 14 serving as a separation member that supports separation of the sheet 1 from the fixing device 4. The separation claw 14 is moved by driving a separation-claw actuator 15 serving as a second drive device and is used when the sheet 1 does not fully separate from the fixing device 4 by adjusting the fixing nip angle with the actuator 6. An exposure unit 12 exposes the photoconductor drum 2 with a light beam.

A controller 200 includes a unit controller 7 that controls the actuator 6, the sheet-moisture-content measurement ammeter 8, the decurler drive motor 11, the exposure unit 12, and the separation-claw actuator 15, and a database 9 on which information on recording sheet is registered.

Toner is fused by heating at the fixing device 4, creating an adhesive force of the toner. Accordingly, a relatively large amount of toner on the sheet 1 may create an increased adhesive force, thus preventing separation of the sheet 1 from the fixing device 4. Consequently, the sheet 1 may wrap around the HR 41, resulting in a so-called "jam" and print interruption. Hence, the image forming apparatus according to the present illustrative embodiment determines the amount (hereinafter, "toner adhesion amount") of toner adhering to a recording sheet and the moisture content of the recording sheet and controls the feed speed of the recording sheet.

Here, one reason that both the moisture content and the toner adhesion amount of the recording sheet are determined is described with reference to FIG. 2.

Figure 2A:
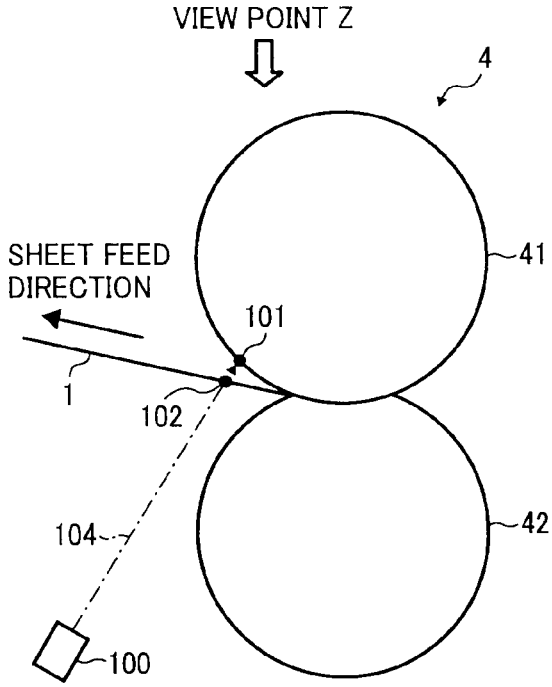
FIG. 2A is a schematic view illustrating a fixing device seen from a width direction of a recording sheet.
Figure 2B:
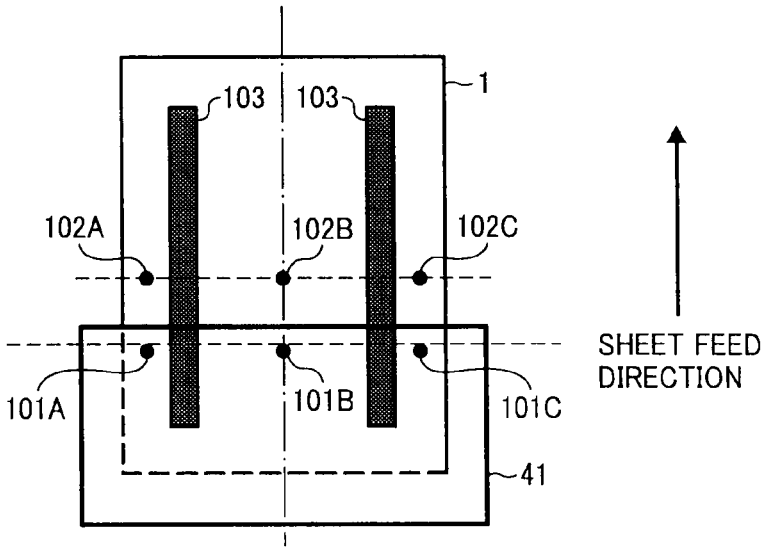
FIG. 2B is a schematic view illustrating the fixing device seen from a view point "Z" illustrated in FIG. 2A.

FIGS. 2A and 2B illustrate a method of a preliminarily performed experiment. FIG. 2A is a schematic view illustrating the fixing device 4 seen from a width direction of the recording sheet 1. FIG. 2B is a schematic view illustrating the fixing device 4 seen from a view point "Z" illustrated in FIG. 2A. In the experiment method, a laser beam 104 is emitted from a light source of a laser displacement gauge 100 at a rotation center on the surface of the HR 41 of the fixing device 4. At this time, the hit point of the laser beam 104 on the HR 41 is defined as a measurement point 101. Thus, the distance from the light source of the laser displacement gauge 100 to the HR 41 is measured. As illustrated in FIG. 2B, three measurement points, e.g., a measurement point 101A, a measurement point 101B, and a measurement point 101C are measured.

Here, the sheet 1 is passed through the fixing device 4. When the sheet 1 is departed from the fixing device 4, the laser beam 104 emitted from the laser displacement gauge 100 hits the sheet 1. The hit point of the laser beam 104 on the sheet 1 is defined as a measurement point 102. Thus, the hit point of the laser beam 104 shifts from the measurement point 101 to the measurement point 102, and the measured distance becomes shorter than the distance measured when the laser beam 104 hits on the surface of the HR 41. Likewise, with respect to the sheet 1, three points, e.g., a measurement point 102A, a measurement point 102B, and a measurement point 102C illustrated in FIG. 2B are measured. As the sheet 1 passed through the fixing device 4, two types of sheets are prepared: one is a blank sheet on which no toner adheres and the other is a sheet on which a certain toner pattern is printed. As the toner pattern, for example, two bands 103 having a width of 20 mm are printed on one face of the sheet.

Figure 3A:
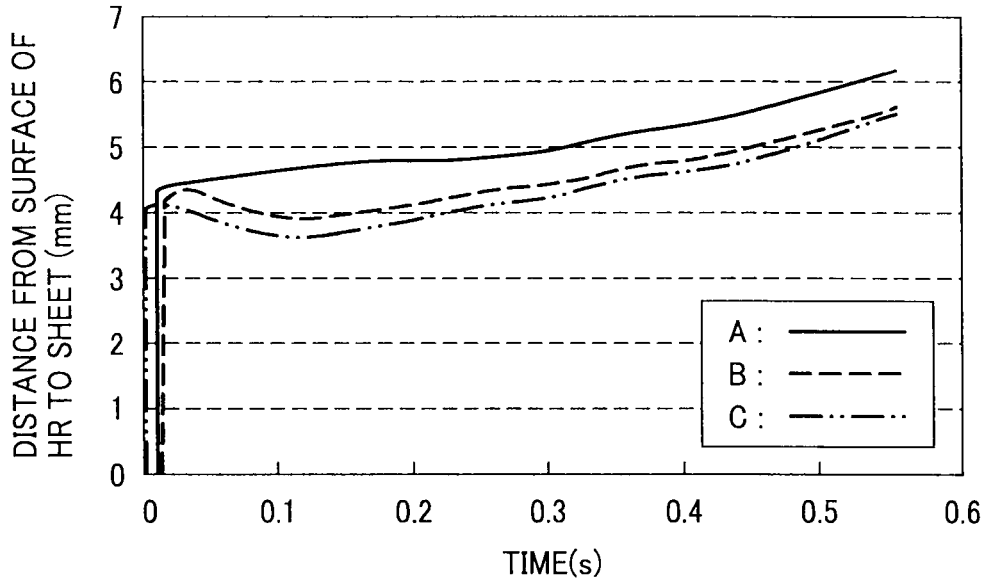
FIG. 3A is a graph illustrating a result of a sheet-pass experiment that compares a blank sheet and a sheet on which a toner pattern is printed.
Figure 3B:
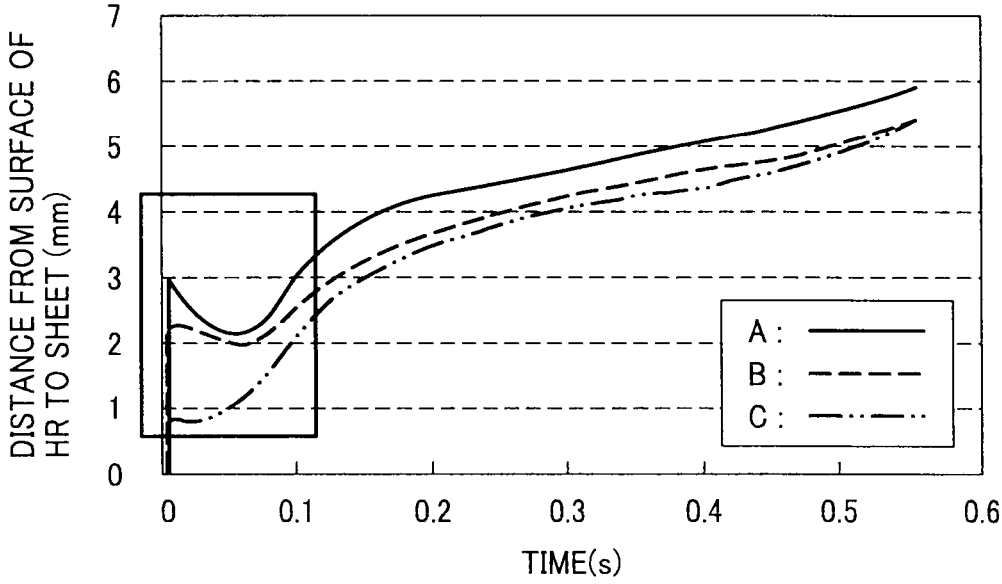
FIG. 3B is a graph illustrating a result of a sheet-pass experiment that compares a blank sheet and a sheet on which a toner pattern is printed.

FIG. 3A and FIG. 3B are graphs illustrating measurement results of the laser displacement gauge 100 obtained when the blank sheet and the sheet having the printed toner pattern are passed through the fixing device 4. The temperature of the fixing device 4 is set to 160° C., and the feed speed and basic weight of the sheet are 200 mm/s and 135 kg, respectively. The vertical axes of the graphs illustrated in FIGS. 3A and 3B indicate the distance from the HR 41 to the hit point 102 at which the laser beam 104 from the light source of the laser displacement gauge 100 hits on the sheet 1. It is to be noted that FIGS. 3A and 3B are examples of experiment results. In FIGS. 3A and 3B, the distance from the measurement point 101A on the surface of the HR 41 to the measurement point 102A on the sheet 1 is indicated by a solid line. The distance from the measurement point 101B on the surface of the HR 41 to the measurement point 102E on the sheet 1 is indicated by a dotted line, and the distance from the measurement point 101C on the surface of the HR 41 to the measurement point 102C on the sheet 1 is indicated by a chain double-dashed line.

FIG. 3A shows an experiment result obtained when the blank sheet passes through the fixing device 4. The distance from the measurement point 101 on the surface of the HR 41 to the measurement point 102 on the sheet 1 is within a range of approximately 3.5 to 6 mm. FIG. 3B shows an experiment result obtained when the sheet having the printed toner pattern passes through the fixing device 4. The distance from the measurement point 101 on the surface of the HR 41 to the measurement point 102 on the sheet 1 is within a range of approximately 0.9 to 6 mm. Comparing the two results, it is found that when the sheet having the printed toner pattern is passed through the fixing device 4, the distance is relatively short, particularly in a time range of 0 to 0.1 s, which is marked by a rectangular frame in FIG. 3B. In other words, it is found that when toner adheres to the sheet 1, the sheet 1 may be more attracted toward the HR 41.

In this experiment, the moisture content of the sheet 1 and the temperature of the fixing device 4 are measured to determine a target feed speed of the sheet 1. In this regard, the higher the temperature of the sheet 1 at the fixing device 4, the sheet 1 may be more attracted to the HR 41 when the sheet 1 is departed from the fixing device 4. Further, when toner adheres to the sheet 1, such effect of the temperature of the sheet 1 at the fixing device 4 may be enhanced, causing the sheet 1 to wrap around the HR 41. Therefore, only detecting the moisture content of the sheet 1 may not prevent such wrapping of the sheet 1. Hence, in the present illustrative embodiment, both the moisture content and the toner adhesion amount of the sheet are measured to control the sheet feed speed.

In the control of the sheet feed speed, reducing the sheet feed speed may result in a reduced productivity. Hence, in the present illustrative embodiment, both the sheet feed speed and the fixing nip angle of the fixing device 4 are adjusted to separate the sheet 1 from the fixing device 4. The fixing nip angle is adjusted by driving the actuator 6. Below, the driving of the actuator 6 is described with reference to FIG. 7.

Figure 7:
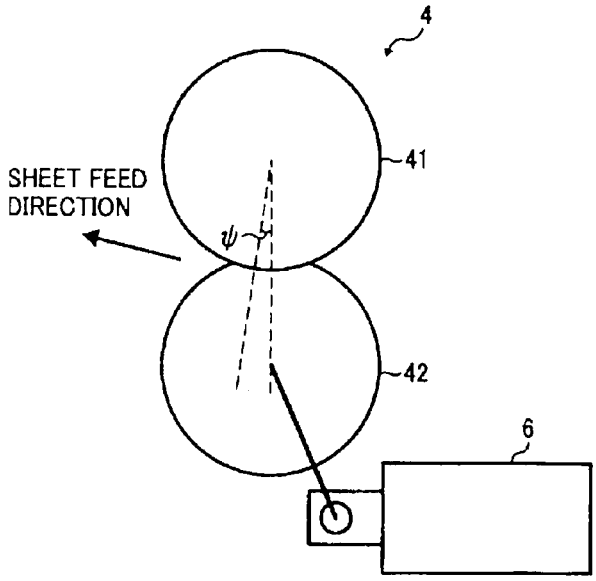
FIG. 7 is a schematic view illustrating driving of a actuator.

FIG. 7 is a schematic view illustrating driving of the actuator 6.

When the fixing nip angle is determined, the drive angle of the actuator 6 is determined. Driving the actuator 6 to move the BR 42 allows changing the fixing nip angle formed by the contact of the HR 41 and the BR 42. The drive angle of the actuator 6 is an angle ("ψ" in FIG. 7) formed by a straight line connecting the centers of the HR 41 and the BR 42 and a direction of the sheet feed speed. In the present illustrative embodiment, since the HR 41 includes a heat source such as a heater, the BR 42 more easily controlled is moved by the actuator 6.

Figure 4:
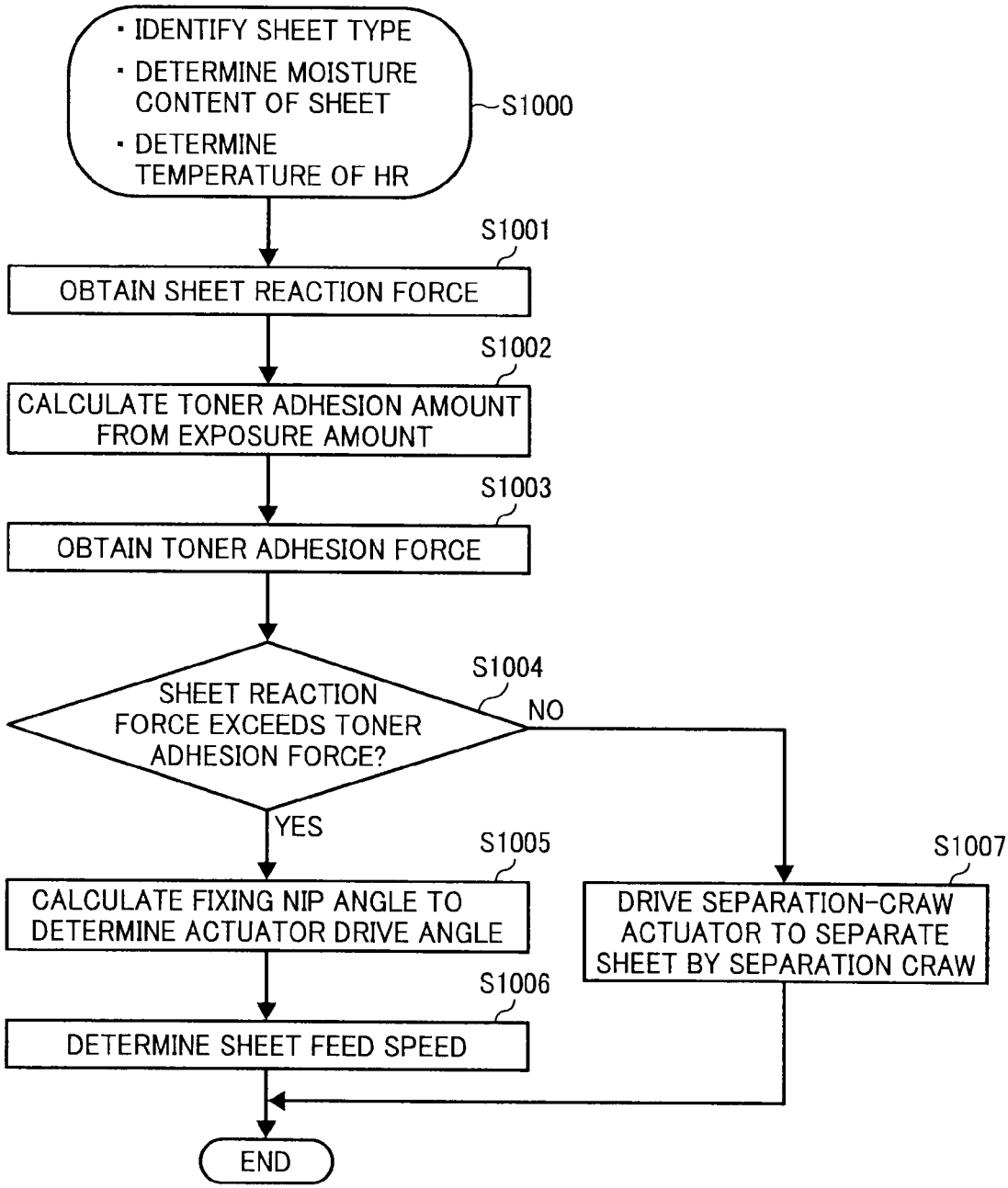
FIG. 4 is a flow chart illustrating a procedure of control performed by a controller.

Next, a process flow of control performed by the controller 200 in accordance with measurements of the moisture content and the toner adhesion amount of the sheet is described with reference to FIG. 4.

At S1000, the controller 200 identifies the type of a recording sheet used and determines the moisture content of the sheet and the temperature of the HR 41. Specifically, information on a plurality of types of sheets is registered in the database 9 by users in advance. When a user selects one of the plurality of types of sheets to start printing, the sheet type used is identified by comparing the selected sheet type with information on the plurality of types of sheets registered in the database 9. The temperature of the HR 41 is detected by a temperature detector provided in the fixing device 4. The moisture content of the sheet 1 is determined by measuring a current flowing through the moisture-content detection roller 3 disposed at the upstream side of the transfer unit using the sheet-moisture-content measurement ammeter 8. In this regard, certain preliminary information on, e.g., the degree of deformation relative to the temperature of sheet and the relation between the moisture content and resistance of sheet allows more precise control. Therefore, when such preliminary information can be identified, such information may be registered in advance in the database 9 and used for the control.

At S1001, the controller 200 calculates a sheet reaction force described below. When the sheet 1 is departed from the fixing device 4, the hardness of the sheet creates a force acting in a direction so that the sheet 1 is attracted toward the BR 42. Here, such a force is called "sheet reaction force". The sheet reaction force is a force to separate and depart the sheet 1 from the fixing device 4, and is determined from the sheet type, the moisture content of the sheet 1, and the temperature of the HR 41 by the unit controller 7.

Figure 5:
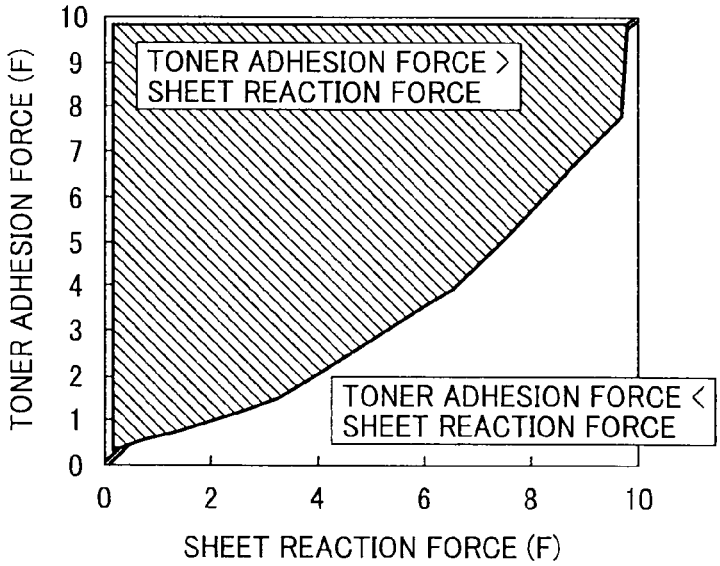
FIG. 5 is a graph illustrating an example of the relation between a sheet reaction force and a toner adhesion force.

At S1002, the controller 200 determines the toner adhesion amount of the sheet 1 in accordance with the printed toner pattern. The toner adhesion amount of the sheet 1 is calculated based on a light amount of the light beam with which the exposure unit 12 exposes the photoconductor drum 2. Based on the calculated toner adhesion amount, at S1003 the adhesive force of the sheet 1 at the fixing device 4 is obtained. Here, the adhesive force is called "toner adhesion force". When toner adhering to the sheet 1 fuses at the fixing device 4, such a toner adhesion force is created. If the toner adhesion force is great, the sheet 1 is more easily attracted to the HR 41 at an exit of the fixing nip of the fixing device 4. In such a case, the sheet 1 may wrap around the HR 41, resulting in a sheet jam. Therefore, to prevent such a failure, it is preferable that the sheet reaction force exceeds the toner adhesion force At 1004, the controller 200 determines whether the sheet reaction force exceeds the toner adhesion force. FIG. 5 is a graph illustrating an example of the relation between the sheet reaction force and the toner adhesion force. In FIG. 5, the hatched area indicates an area in which the toner adhesion force exceeds the sheet reaction force, while the blank area indicates an area in which the sheet reaction force exceeds the toner adhesion force. In this regard, the term "the toner adhesion force exceeds the sheet reaction force" represents a situation in which the sheet 1 is attracted to the HR 41 when departed from the fixing device 4. By contrast, the term "the sheet reaction force exceeds the toner adhesion force" represents a situation in which the sheet 1 is not attracted to the HR 41 when output from the fixing device 4. From FIG. 5, it is found that regardless of whether the toner adhesion force actually exceeds the sheet reaction force, the controller 2000 may determine that the toner adhesion force exceeds the sheet reaction force. This is because the relation between the toner adhesion force and the sheet reaction force illustrated in FIG. 5 is obtained from a preliminary experiment. In the experiment, even if the toner adhesion force is actually smaller than the sheet reaction force, the sheet 1 may be attracted toward the HR 41 when departed from the fixing device 4. In such a case, the controller 200 determines that the toner adhesion force exceeds the sheet reaction force even if the toner adhesion force is actually smaller than the sheet reaction force.

As described above, when the sheet reaction force and the toner adhesion force are obtained, the controller 200 calculates a difference between the sheet reaction force and the toner adhesion force and determines whether the sheet reaction force exceeds the toner adhesion force. If the sheet reaction force exceeds the toner adhesion force ("YES" at S1004), at S1005 the controller 200 determines the drive angle of the actuator 6 and at S1006 determines the feed speed of the sheet 1. By contrast, if the toner adhesion force exceeds the sheet reaction force ("NO" at S1004), since the sheet 1 may not fully separate from the fixing device 4 even when the controller 200 drives the actuator 6, at S1007 the controller 200 supports separation of the sheet 1 from the fixing device 4 with the separation claw 14. The separation claw 14 is moved by driving the separation claw actuator 15 and is used when the sheet 1 does not fully separate from the fixing device 4 by driving the actuator 6. In the present illustrative embodiment, since the separation claw 14 may give damage to the HR 41 or deteriorate itself, the separation claw 14 is used when the controller 200 determines that the toner adhesion force exceeds the sheet reaction force.

Here, a description is given of determination of the fixing nip angle when the controller 200 determines that the sheet reaction force exceeds the toner adhesion force by comparing them.

Figure 6:
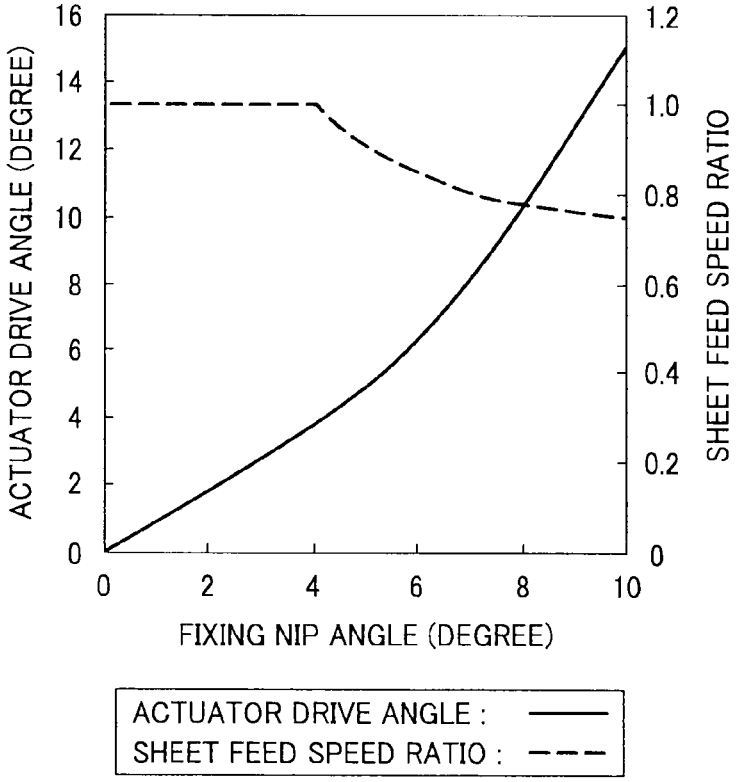
FIG. 6 is a graph illustrating an example of the relation between a fixing nip angle, a drive angle of an actuator, and a sheet feed speed ratio.
Figure 8:
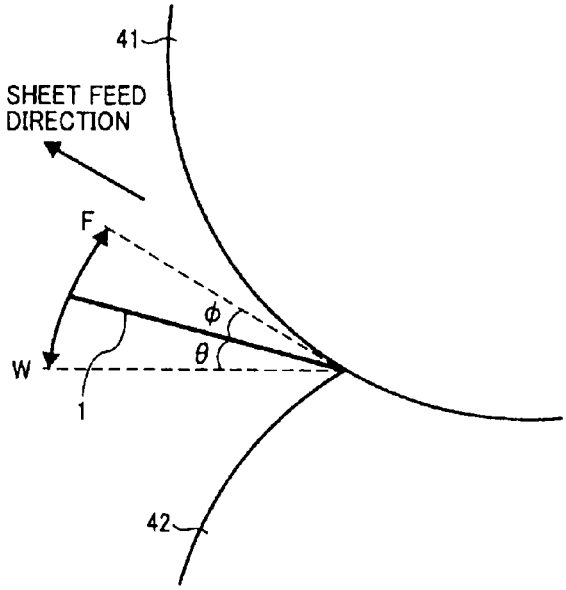
FIG. 8 is an illustration for explaining a sheet reaction force and a toner adhesion force.

FIG. 6 is an example of a graph used to determine the fixing nip angle and the sheet feed speed ratio based on the difference between the sheet reaction force and the toner adhesion force when the sheet reaction force exceeds the toner adhesion force. In FIG. 6, a solid line indicates the drive angle of the actuator 6, and a dotted line indicates a sheet feed speed ratio, i.e., a ratio of the target feed speed to the feed speed determined in advance. The difference between the sheet reaction force and the toner adhesion force corresponds to the fixing nip angle at which the sheet 1 is departed from the fixing device 4. Although the sheet reaction force and the toner adhesion force are represented in units of force, as illustrated in FIG. 8, the sheet reaction force is a force generated by curling of the sheet 1 toward the BR 42 when the sheet 1 is output from the fixing device 4, and the toner adhesion force is a force created when the sheet 1 is attracted toward the HR 41 by an adhesive force of toner on the sheet 1. Each of the sheet reaction force and the toner adhesion force is proportional to the angle relative to the sheet 1. In FIG. 8, the sheet reaction force is represented by W and is proportional to $\theta$. The toner adhesion force is represented by F and is proportional to $\Phi$. The difference between these forces corresponds to the difference between the angles $\theta$ and $\Phi$. The angle difference ($\theta-\Phi$) is determined to be the fixing nip angle. Thus, when the fixing nip angle is determined, the drive angle of the actuator 6 and the feed speed of the sheet 1 are determined.

The drive angle of the actuator 6 is increased in substantially proportional to an increase in the fixing nip angle. However, although the sheet feed speed is constant when the fixing nip angle is in a range of approximately 0 to 4 degrees, the controller 200 slightly reduces the sheet feed speed when the fixing nip angle exceeds the range. For the control of the sheet feed speed, a proper relation between the sheet feed speed and the fixing nip angle is determined based on results of experiments. The reduction value of the sheet feed speed is not constant and is determined based on a certain reduction rate. Further, the reduction value is adjusted with the fixing nip angle. In the present illustrative embodiment, the sheet feed speed is determined to be, e.g., 100 to 400 mm/s in advance of the comparison of the sheet reaction force and the toner adhesion force, determination of the change of the sheet feed speed, and determination of the drive angle of the actuator 6. In accordance with results of the comparison and determinations, the actuator 6 is driven, and the sheet feed speed is adjusted by changing the speed of the sheet conveyance belt 10.

Here, a description is given of examples of determination of the sheet reaction force and the toner adhesion force and determination of the drive angle of the actuator 6, the sheet feed speed, and the use of the separation claw 14.

For example, assume that the sheet reaction force is six while the toner adhesion force is three. Then, the sheet reaction force is greater than the toner adhesion force, and the difference between them is three. In this case, the fixing nip angle is three. Accordingly, from the graph illustrated in FIG. 6, the drive angle of the actuator 6 is determined to be 2.5 degrees. At this time, the target sheet feed speed is set to the sheet feed speed determined in advance.

Another example is described below. For example, assume that the sheet reaction force is eight while the toner adhesion force is one. Then, the sheet reaction force is greater than the toner adhesion force, and the difference between them is seven. In this case, the fixing nip angle is seven. Accordingly, from the graph illustrated in FIG. 6, the drive angle of the actuator 6 is determined to be eight degrees. At this time, the target sheet feed speed is set to a speed of 0.8 times the sheet feed speed determined in advance.

Still another example is described below. For example, assume that the sheet reaction force is four while the toner adhesion is two. In this case, with reference to FIG. 5, it is determined that the sheet reaction force exceeds the toner adhesion force. The difference between them is two, and the fixing nip angle is two. Accordingly, from the graph illustrated in FIG. 6, the drive angle of the actuator 6 is determined to be 1.8 degrees. At this time, the target sheet feed speed is set to the sheet feed speed determined in advance.

Next, a description is given of examples of the above-described comparison and determinations when the toner adhesion force exceeds the sheet reaction force.

For example, assume that the sheet reaction force is two while the toner adhesion force is six. Then, the toner adhesion force is greater than the sheet reaction force. In this case, the controller 200 drives the separation-claw actuator 15 to separate the sheet 1 from the fixing device 4 with the separation claw 14.

Thus, the controller 200 determines whether the sheet reaction force exceeds the toner adhesion force. Further, based on the determination result, the controller 200 determines the fixing nip angle of the fixing device 4, the sheet feed speed of the recording sheet 1, and whether the separation claw 14 should be used.

Further, a description is given below of a case in which the separation claw 14 is used when the sheet reaction force exceeds the toner adhesion force.

For example, assume that the sheet reaction force is eight while the toner adhesion force is six. In this case, the sheet reaction force is greater than the toner adhesion force. However, with reference to FIG. 5, the controller 200 determines that the toner adhesion force is greater than the sheet reaction force. Accordingly, in this case, the controller 200 drives the separation-claw actuator 15 to separate the sheet 1 from the fixing device 4 with the separation claw 14.

Next, use of the decurler 5 is described.

As illustrated in FIG. 1, the decurler 5 including the roller to correct curling of the sheet 1 is disposed at a downstream side of the fixing device 4 in the sheet feed direction. When the sheet 1 is departed from the fixing device 4, the temperature of the sheet 1 is still high. At this time, the sheet 1 curls in a downward convex shape. Hence, to correct the curling of the sheet 1 before the temperature of the sheet 1 falls, the decurler 5 applies a force acting in a direction so that the sheet 1 is deformed in a upward convex shape, thus correcting the curling of the sheet 1. Further, the cooling device 13 cools the sheet 1. Thus, the sheet 1 is output in a substantially flat shape from a sheet output section.

The above-described configuration allows preventing a failure such as a sheet jam at the fixing device, thus providing an enhanced product reliability.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. An image forming apparatus, comprising:

a controller;

a database to register information on a plurality of types of recording media in the controller;

an image carrier to carry a toner image;

an exposure unit to expose the image carrier;

a transfer unit to transfer the toner image from the image carrier to a recording medium;

a fixing device to fix the toner image transferred on the recording medium at the transfer unit using heat and pressure, the fixing device comprising a temperature detector to detect a temperature of the fixing device and a first drive device to change a fixing nip angle of the fixing device, the fixing nip angle being an angle of departure of the recording medium from the fixing device;

a speed changer disposed at an upstream side of the fixing device in a feed direction of the recording medium to change a feed speed of the recording medium; and an electric-current detector disposed at an upstream side of the transfer unit in the feed direction of the recording medium to measure an electric current flowing through the recording medium, wherein the controller calculates a toner adhesion amount of toner adhering to the toner image on the recording medium from an exposure amount of the exposure unit, identifies a type of the recording medium based on the information on the plurality of types of recording media registered in the database when the recording medium is selected from the plurality of recording media by a user, detects a temperature of the fixing device with the temperature detector, determines a moisture content of the recording medium from the electric current flowing through the recording medium measured with the electric-current detector, calculates a reaction force of the recording medium arising when the recording medium is fed out of the fixing device, calculates from the toner adhesion amount a toner adhesion force generated by the toner image fused with the heat of the fixing device, compares the reaction force and the toner adhesion force, determines the fixing nip angle when the controller determines that the reaction force exceeds the toner adhesion force, drives the first drive device to set the fixing device to the fixing nip angle, determines a target speed of the feed speed of the recording medium, and drives the speed changer to change the feed speed of the recording medium to match the target speed.

2. The image forming apparatus according to claim 1, wherein the fixing device further comprises a separation member to separate the recording medium from the fixing device and a second drive device to drive the separation member, and when the controller determines that the toner adhesion force exceeds the reaction force, the controller determines to use the separation member and drives the second drive device to separate the recording medium from the fixing device with the separation member.

3. The image forming apparatus according to claim 1, Further comprising:

a correction device to correct deformation of the recording medium at a downstream side of the fixing device in the feed direction of the recording medium; and a cooling device to cool the recording medium.

4. An image forming apparatus control method for controlling operation of an image forming apparatus, the image forming apparatus comprising:

a controller;

a database to register information on a plurality of types of recording media in the controller;

an image carrier to carry a toner image;

an exposure unit to expose the image carrier;

a transfer unit to transfer the toner image from the image carrier to a recording medium;

a fixing device to fix the toner image transferred on the recording medium at the transfer unit using heat and pressure, the fixing device comprising a temperature detector to detect a temperature of the fixing device and a first drive device to change a fixing nip angle of the fixing device, the fixing nip angle being an angle of departure of the recording medium from the fixing device;

a speed changer disposed at an upstream side of the fixing device in a feed direction of the recording medium to change a feed speed of the recording medium; and an electric-current detector disposed at an upstream side of the transfer unit in the feed direction of the recording medium to measure an electric current flowing through the recording medium, the method comprising:

calculating a toner adhesion amount of toner adhering to the toner image on the recording medium from an exposure amount of the exposure unit identifying a type of the recording medium based on the information on the plurality of types of recording media registered in the database when the recording medium is selected from the plurality of recording media by a user;

detecting a temperature of the fixing device with the temperature detector;

determining a moisture content of the recording medium from the electric current flowing through the recording medium measured with the electric-current detector;

calculating a reaction force of the recording medium arising when the recording medium is fed out of the fixing device;

calculating from the toner adhesion amount a toner adhesion force generated by the toner image fused with the heat of the fixing device;

comparing the reaction force and the toner adhesion force;

determining the fixing nip angle when the controller determines that the reaction force exceeds the toner adhesion force;

driving the first drive device to set the fixing device to the fixing nip angle;

determining a target speed of the feed speed of the recording medium; and driving the speed changer to change the feed speed of the recording medium to match the target speed.

5. The image forming apparatus control method according to claim 4, the fixing device further comprising a separation member to separate the recording medium from the fixing device and a second drive device to drive the separation member;

the control method further comprising:

determining to use the separation member and driving the second drive device to separate the recording medium from the fixing device with the separation member when it is determined that the toner adhesion force exceeds the reaction force.

6. The image forming apparatus control method according to claim 4, further comprising:

correcting deformation of the recording medium at a downstream side of the fixing device in the feed direction of the recording medium; and cooling the recording medium after correcting deformation of the recording medium.

* * * * *